US008439774B2

(12) United States Patent
Massey

(10) Patent No.: US 8,439,774 B2
(45) Date of Patent: May 14, 2013

(54) PITCHING MOVEMENT TRAINING DEVICE

(76) Inventor: William J. Massey, Park Ridge, NJ (US)

( * ) Notice: Subject to any disclaimer, the term of this patent is extended or adjusted under 35 U.S.C. 154(b) by 0 days.

(21) Appl. No.: 13/206,917

(22) Filed: Aug. 10, 2011

(65) Prior Publication Data

US 2013/0040766 A1 Feb. 14, 2013

(51) Int. Cl.
*A63B 69/00* (2006.01)
*A63B 37/00* (2006.01)

(52) U.S. Cl.
USPC ..... 473/451; 473/458; 473/613; 473/422

(58) Field of Classification Search ..... 473/422, 473/450, 458, 464, 454, 575, 451, 614, 596, 473/595, 594, 613; D21/707, 713
See application file for complete search history.

(56) References Cited

U.S. PATENT DOCUMENTS

| | | | | | |
|---|---|---|---|---|---|
| 443,036 | A | | 12/1890 | Burns | |
| 563,170 | A | * | 6/1896 | Windoes | 473/595 |
| 2,078,382 | A | * | 4/1937 | Hanshaw | 473/595 |
| 2,309,475 | A | * | 1/1943 | Palmieri | 446/240 |
| 2,448,731 | A | | 9/1948 | Park et al. | |
| 2,884,254 | A | | 4/1959 | Miner | |
| 2,925,273 | A | * | 2/1960 | Pratt | 473/451 |
| 3,110,494 | A | * | 11/1963 | Morgan | 473/458 |
| 4,191,178 | A | * | 3/1980 | Wisnieski | 601/131 |
| 4,460,172 | A | | 7/1984 | Hogan | |
| 4,875,689 | A | * | 10/1989 | Lin | 473/573 |
| 5,028,053 | A | * | 7/1991 | Leopold | 473/473 |
| 5,158,284 | A | * | 10/1992 | Vogl | 473/594 |
| 5,183,263 | A | * | 2/1993 | Kuebler | 473/573 |
| 5,250,016 | A | | 10/1993 | Higgins | |
| 5,251,908 | A | * | 10/1993 | Myers | 473/607 |
| 5,407,193 | A | | 4/1995 | McGinley | |
| D358,858 | S | * | 5/1995 | McGreevy | D21/707 |
| 5,700,211 | A | * | 12/1997 | Mackie | 473/613 |
| 5,964,639 | A | * | 10/1999 | Maxim | 446/437 |
| 6,050,907 | A | * | 4/2000 | Long | 473/453 |
| 6,093,118 | A | | 7/2000 | Simpson | |
| 6,663,519 | B2 | | 12/2003 | Kuhn et al. | |
| D506,233 | S | | 6/2005 | Cruz | |
| 7,445,569 | B2 | | 11/2008 | Comello, Jr. | |
| 7,458,945 | B2 | * | 12/2008 | Zemont | 601/131 |
| D619,663 | S | | 7/2010 | Quinn | |
| 7,753,811 | B2 | * | 7/2010 | Mark | 473/422 |
| D646,735 | S | | 10/2011 | Nichols et al. | |
| D653,810 | S | | 2/2012 | Gelin | |
| 8,197,363 | B1 | * | 6/2012 | Davignon | 473/451 |
| 2005/0009650 | A1 | | 1/2005 | Sullivan, III | |
| 2006/0217220 | A1 | * | 9/2006 | Davignon | 473/613 |
| 2008/0318734 | A1 | | 12/2008 | Parnell | |
| 2010/0048331 | A1 | | 2/2010 | Guilfoyle | |

* cited by examiner

*Primary Examiner* — Mitra Aryanpour
(74) *Attorney, Agent, or Firm* — Welsh Flaxman & Gitler LLC

(57) ABSTRACT

A pitching movement training device includes a ball, a plurality of pegs selectively secured at predetermined locations about the surface of the ball, and at least one band secured between adjacent pegs. The ball has a seam and at least one of the pegs being positioned adjacent the seam. The ball allows one to teach athletes proper hand positioning upon a ball while throwing specific pitches. The method includes providing the plurality of pegs and the ball, securing the pegs to the ball at predetermined locations about the outer surface of the ball, positioning a user's fingers relative to the pegs; and instructing the user to throw a pitch with a specific hand motion.

18 Claims, 9 Drawing Sheets

PITCHING MOVEMENT TRAINING DEVICE

BACKGROUND OF THE INVENTION

1. Field of the Invention

The present invention relates to a pitching movement training device teaching athletes proper hand positioning upon either a baseball or a softball while throwing specific pitches.

2. Description of the Related Art

Whether considering baseball or softball, most experts will agree that pitching is truly an art form. The pitcher is required to coordinate finger motion and positioning upon a ball with arm and body motion in a manner controlling the movement of the ball as it moves from the pitchers hand to the plate where a batter attempts to strike the ball with a bat. All of this must be coordinated without allowing the batter to predetermine which pitch the pitcher intends to throw.

Many beginning players unfortunately do not appreciate the importance the proper positioning of their fingers, that is, gripping, plays in correctly executing various pitches. In many instances young players simply pick up a ball and begin throwing, dangerously contorting their arm to achieve different spins upon the ball. Without the aid of trained professional, it is virtually impossible for a younger player to properly determine finger position upon a ball in order to properly execute different pitches. Even when a young player has access to a trained professional for advice, the professional is not always present to reinforce the proper finger positioning and bad habits develop when young players begin improperly positioning their fingers upon a ball during throwing activities.

With the foregoing in mind, the present inventor has developed a pitching movement training device providing tactile and feedback to young pitchers in a manner that allows for ready adjustment to teach and practice various pitching grips.

SUMMARY OF THE INVENTION

It is, therefore, an object of the present invention to provide a pitching movement training device including a ball and a plurality of pegs selectively secured at predetermined locations about the surface of the ball. The training device also includes at least one band secured between adjacent pegs.

It is also an object of the present invention to provide a pitching movement training device wherein the ball is a baseball.

It is another object of the present invention to provide a pitching movement training device wherein the ball includes ten holes shaped and dimensioned for receiving the pegs.

It is a further object of the present invention to provide a pitching movement training device wherein the ball includes seams and the holes are formed adjacent the seams It is also an object of the present invention to provide a pitching movement training device wherein the ball is a softball.

It is another object of the present invention to provide a pitching movement training device wherein the ball includes a seam and the pegs are positioned adjacent the seam.

It is a further object of the present invention to provide a pitching movement training device wherein the ball includes a plurality of threaded holes shaped and dimensioned for receiving the pegs.

It is also an object of the present invention to provide a pitching movement training device wherein the band is a rubber band.

It is also an object of the present invention to provide a pitching movement training device including a ball having a seam and a plurality of pegs selectively secured at predetermined locations about the surface of the ball, at least one of the pegs being positioned adjacent the seam.

It is also an object of the present invention to provide a method for teaching athletes proper hand positioning upon a ball while throwing specific pitches. The method includes providing a plurality of pegs and a ball, the plurality of pegs being shaped and dimensioned for selective attachment to the ball. The method further includes securing the pegs to the ball at predetermined locations about the outer surface of the ball, positioning a user's fingers relative to the pegs; and instructing the user to throw a pitch with a specific hand motion.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as a basis for teaching one skilled in the art how to make and/or use the invention.

Figure 1:
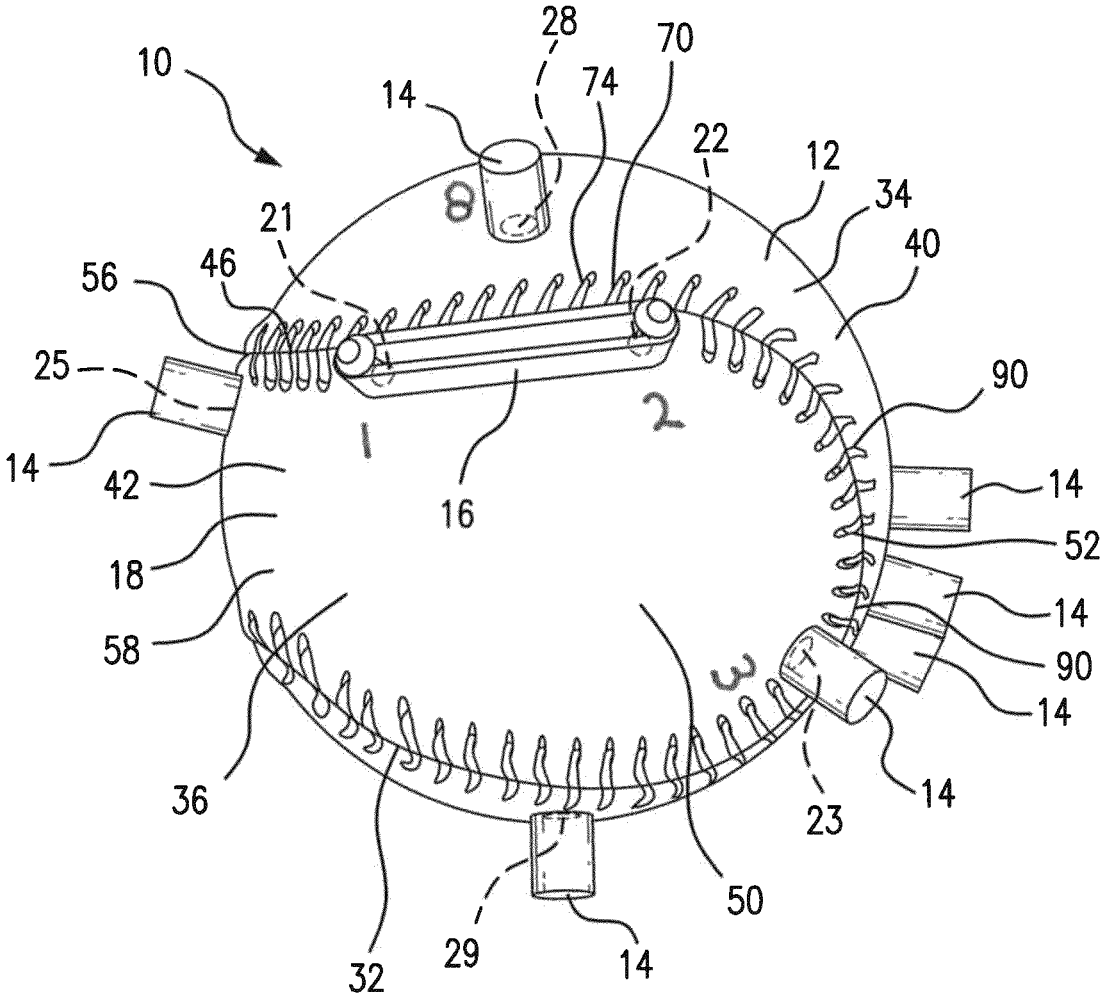
FIGS. 1 to 5 show various view of a baseball in accordance with the present invention.
Figure 2:
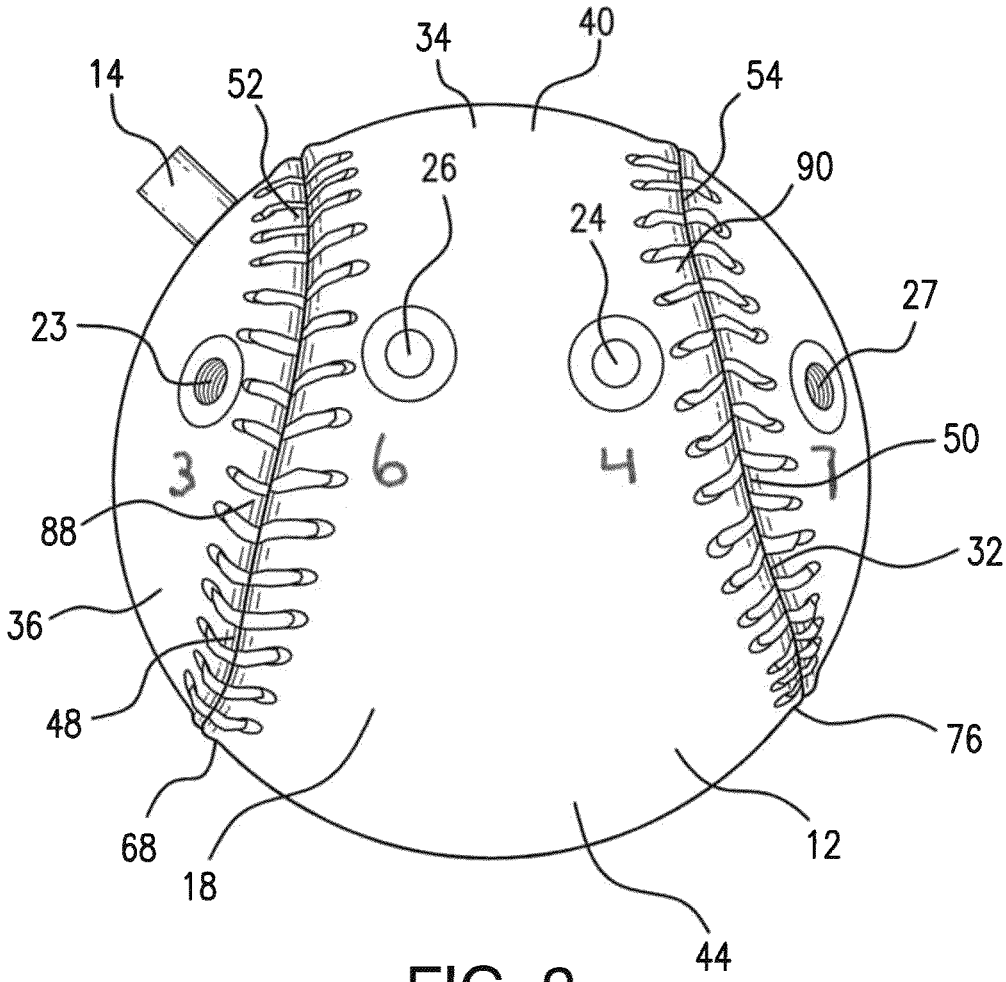
Figure 3:
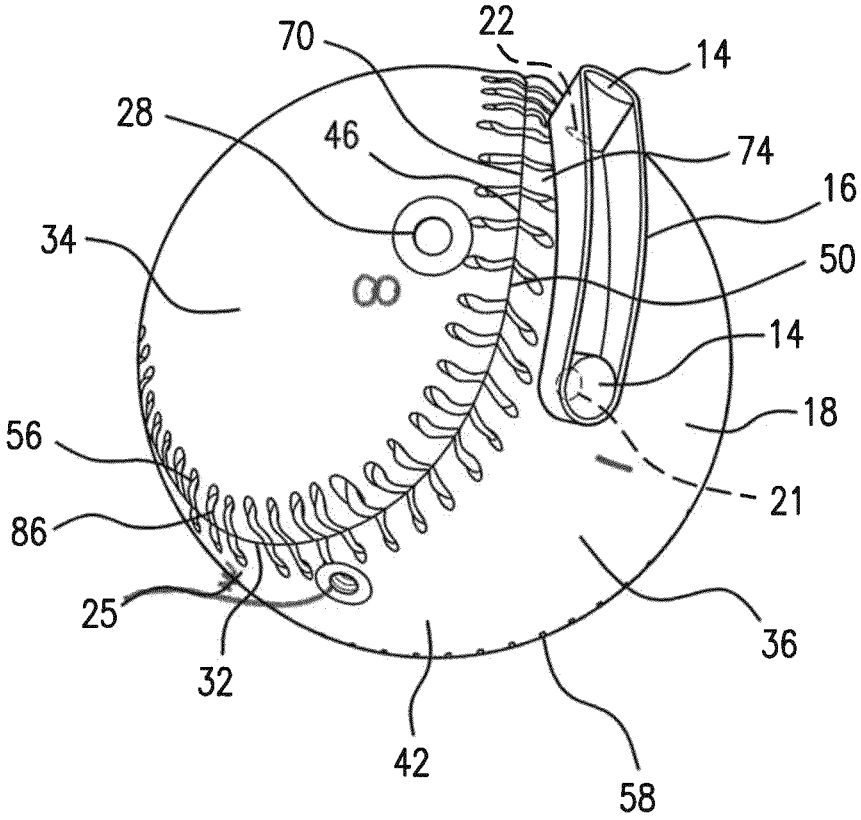
Figure 4:
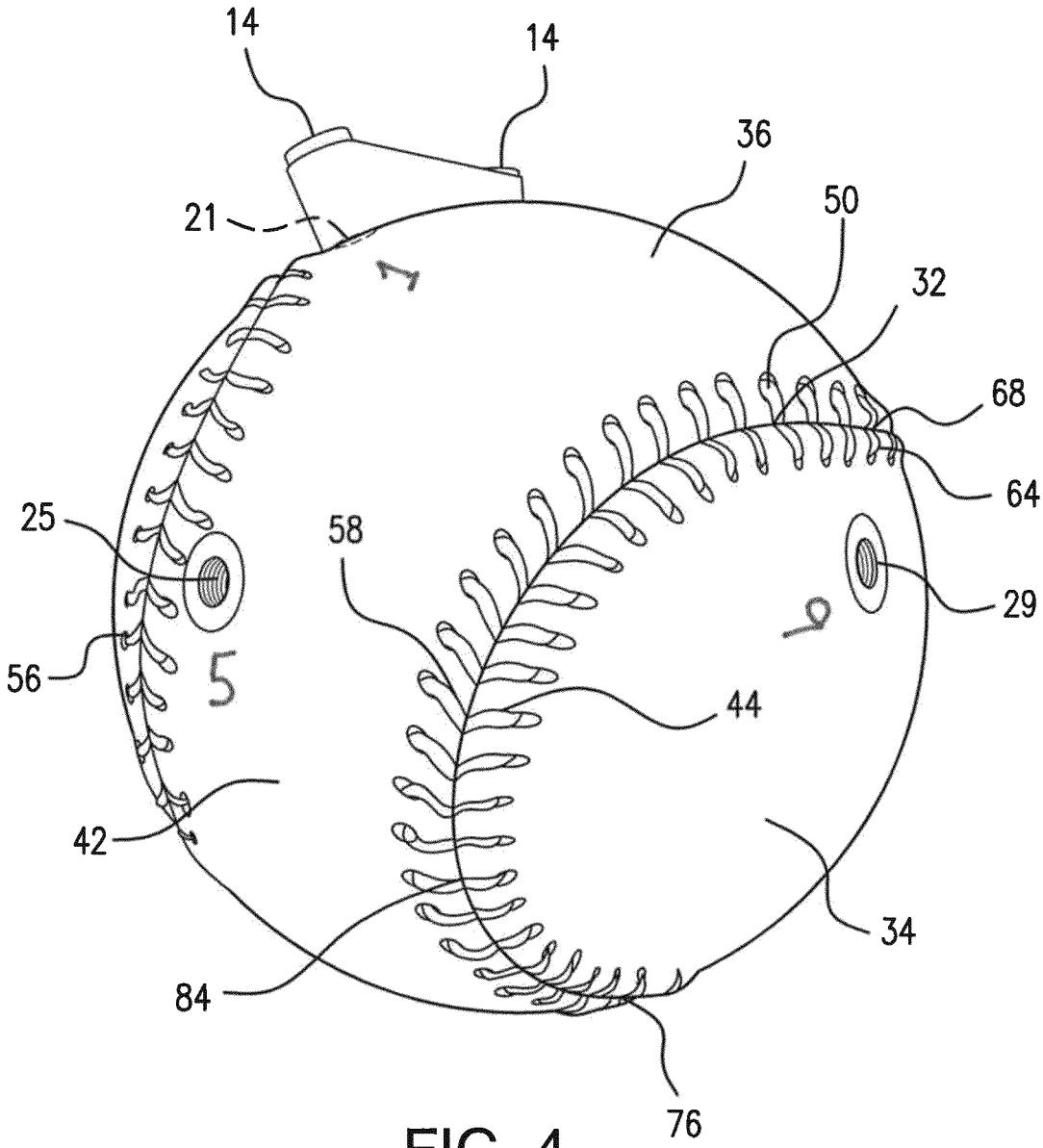
Figure 5:
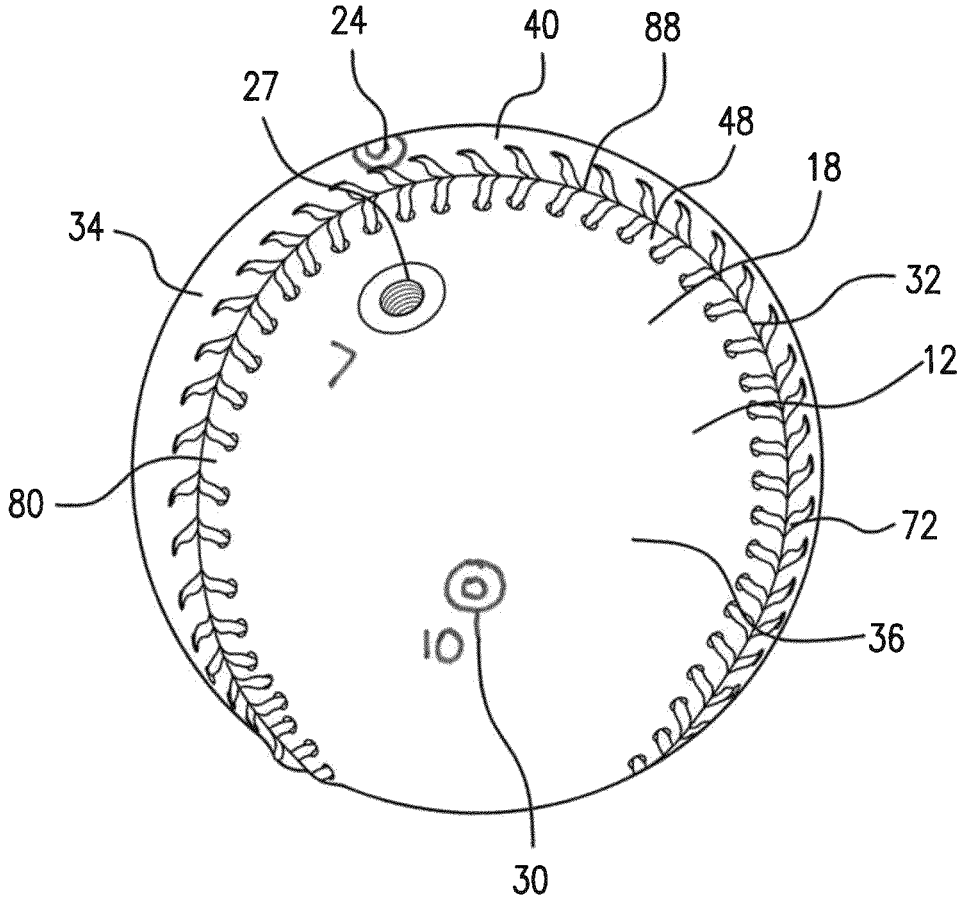
Figure 7:
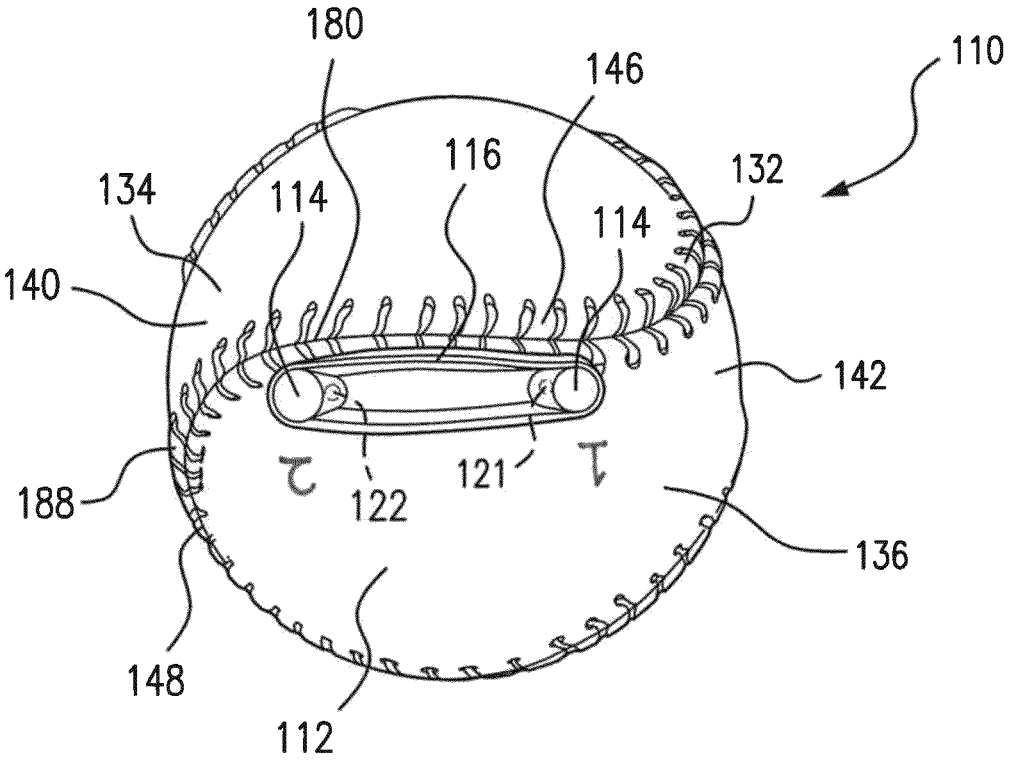
FIGS. 7 to 10 are various view of a softball in accordance with the present invention.
Figure 6:
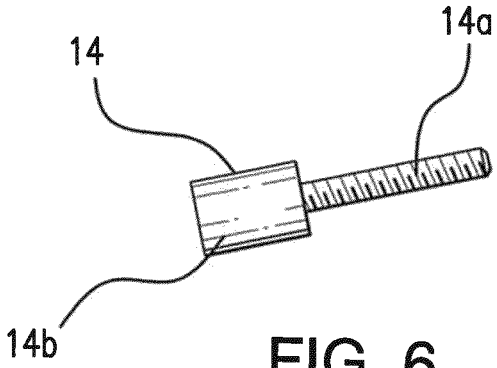
FIG. 6 is a perspective view of a peg used in accordance with the present invention.
Figure 8:
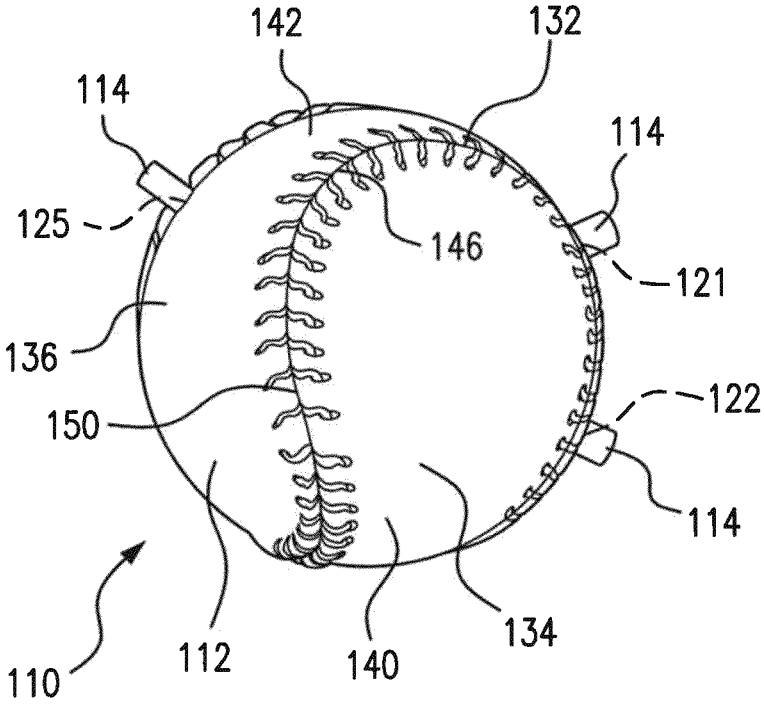
Figure 9:
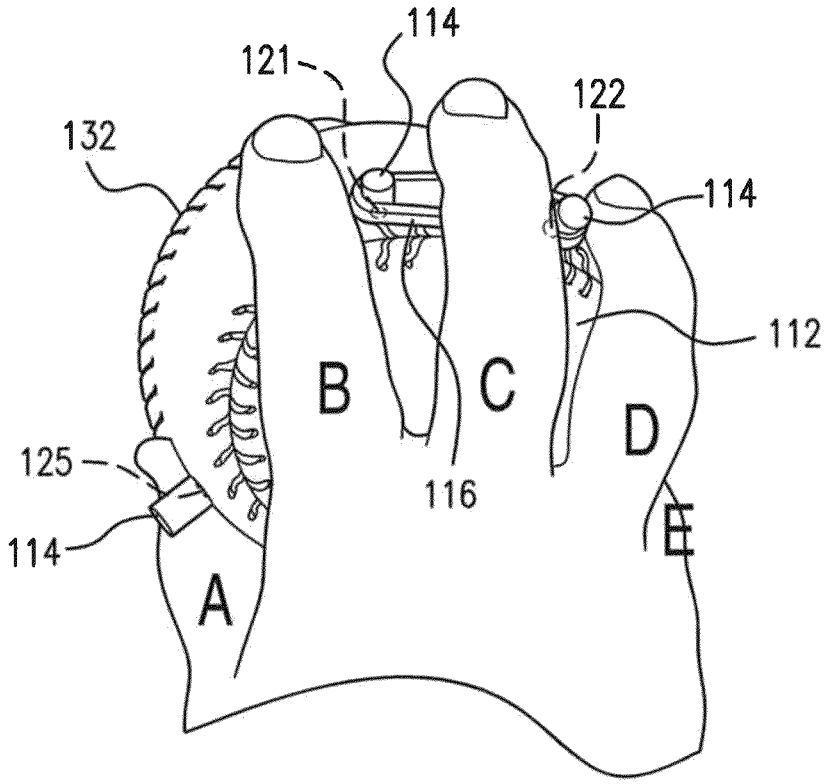
Figure 10:
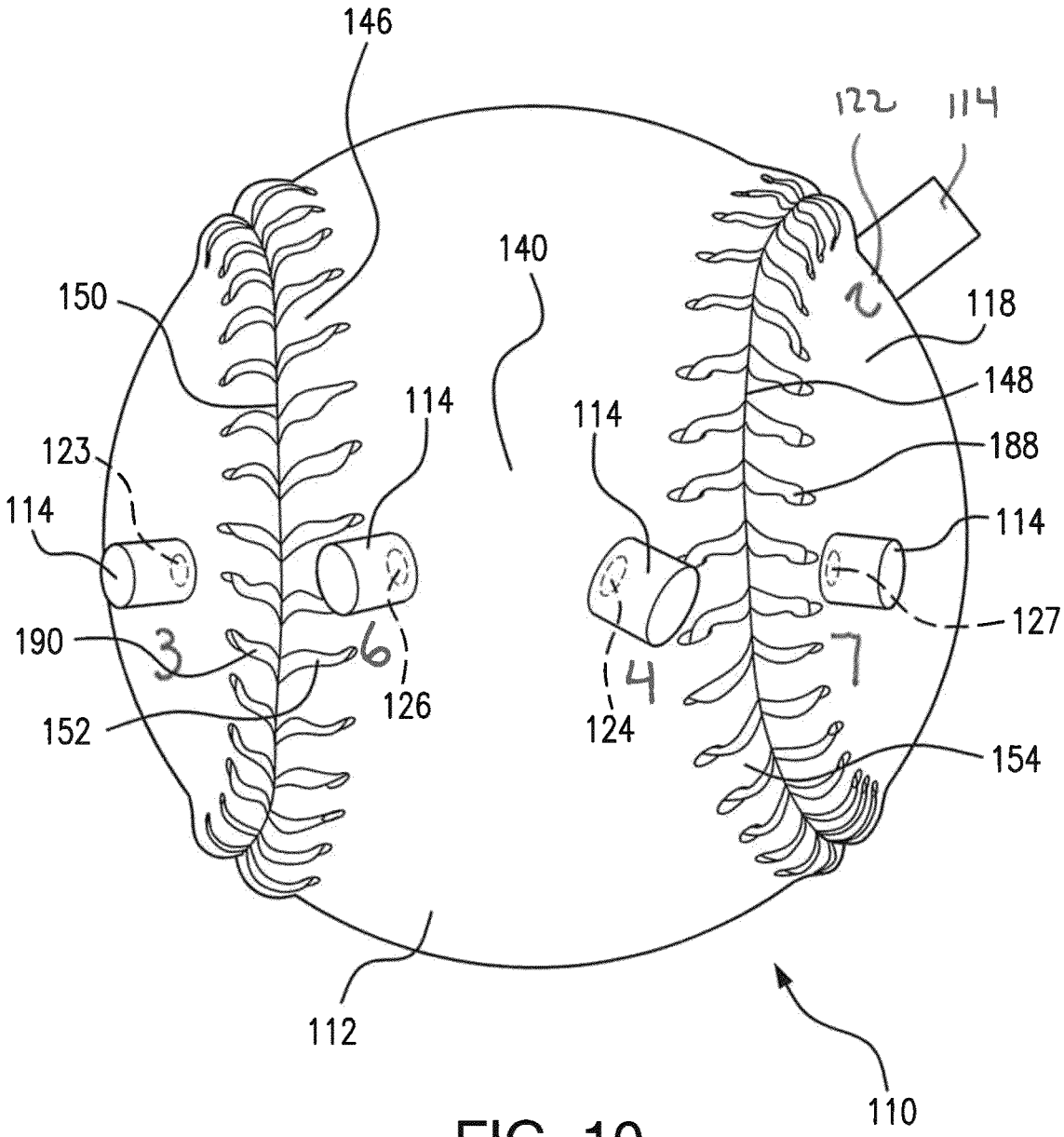

In accordance with the present invention, and with reference to FIGS. 1 to 5 and 7 to 10 a pitching movement training device 10, 110 is disclosed. The training device 10, 110 includes a ball 12, 112 sized and shaped to replicate either a baseball or a softball. As such, and in accordance with the baseball embodiment, the ball 12 will have a circumference of approximately 9 inches and a weight of approximately 5 oz. With regard to the softball embodiment, the ball 112 will have a circumference of approximately 11 inches to 14 inches and a weight of approximately 5.875 oz. to 7.0 oz.

The ball 12, 112 is provided with a plurality of internally threaded recesses or holes shaped and dimensioned for selective placement of a pegs 14, 114 therein. The pegs 14, 114 are identical and include a threaded distal end 14*a*, 114*a* for selective attachment within the internally threaded holes and a proximal end 14*b*, 114*b* shaped and dimensioned for engagement with a player's fingers. The training device 10, 110 also includes at least one rubber band 16, 116 for selectively positioning between adjacent pegs.

In accordance with a preferred embodiment, the holes are formed at preselected locations about the outer surface 18, 118 of the ball 12, 112. The position of the holes is chosen so as to permit a variety of peg 14, 114 arrangements allowing users to adjust the peg arrangement so as to training for different pitches as discussed below in greater detail.

The present training device 10, 110 is used in teaching athletes proper hand positioning upon a ball while throwing specific pitches. The method involves providing a plurality of pegs 14, 114 and a ball 12, 112, the plurality of pegs 14, 114 being shaped and dimensioned for selective attachment to the ball 12, 112. The pegs 14, 114 are selectively secured to the ball 12, 112 at predetermined locations about the outer surface 18, 118 of the ball 12, 112, the user's fingers are positioned relative to the pegs 14, 114, and the user is instructed to throw a pitch with a specific hand motion.

In accordance with a baseball embodiment as shown with reference to FIGS. 1 to 5, the baseball 12 is provided with ten (10) holes 21-30 (in order to facilitate use of the present ball the holes are marked 1, 2, 3, 4, 5, 6, 7, 8, 9 and 10 on the outer surface 18 of the ball 12). In accordance with a softball embodiment as shown with reference to FIGS. 7 to 10, the softball 112 is provided with seven (7) holes 121-127 (in order to facilitate use of the present ball the holes are marked 1, 2, 3, 4, 5, 6 and 7 on the outer surface 118 of the ball 112). Referring first to the baseball embodiment, the holes 21-30 are arranged about the baseball 12 to permit training of various pitches and are accordingly arrangement based upon their relative proximity to the seams formed about the baseball 12.

As a reference for the following discussion, a conventional baseball 12 can be thought of as including a single seam 32 formed in a serpentine pattern for the purpose of securing first and second cover members 34, 36 about the core (not shown) of the baseball 12 so as to define the outer surface 18 of the baseball 12. Although serpentine, the single seam 32 of a baseball 12 is highly symmetrical and includes first and second narrow seam sections 40, 42 connecting first, second, third and fourth horseshoe shaped seam sections 44, 46, 48, 50. The first and second narrow seam sections 40, 42 are positioned on opposite sides of the ball 12 and are each composed of adjacent first and second lateral seam members 52, 54, 56, 58 at their closest points. The sole difference between the first and second narrow seam sections 40, 42 resides in the fact that the axis extending between the adjacent first and second lateral seam members 52, 54, 56, 58 of the respective first and second narrow seam sections 40, 42 are oriented at 90 degrees relative to each other.

With regard to the first, second, third and fourth horseshoe shaped seam sections 44, 46, 48, 50, these are looped sections extending on opposite sides of the respective first and second narrow seam sections 40, 42. In particular, the first horseshoe shaped seam section 44 is composed of a looped and bulbous seam connecting the first and second lateral seam members 52, 54 making up the first narrow seam section 40, while the second horseshoe shaped seam section 46 is composed of a looped and bulbous seam connecting the opposite sides of the first and second lateral seam members 52, 54 making up the first narrow seam section 40. Similarly, the third horseshoe shaped seam section 48 is composed of a looped and bulbous seam connecting the first and second lateral seam members 56, 58 making up the second narrow seam section 42, while the fourth horseshoe shaped seam section 50 is composed of a looped and bulbous seam connecting the opposite sides of the first and second lateral seam members 56, 58 making up the second narrow seam section 42. Each of the first, second, third and fourth horseshoe shaped seam sections 44, 46, 48, 50 may be thought of as including a first lateral arcuate seam member 68, 70, 72, 74, a second lateral arcuate seam member 76, 78, 80, 82 and an arcuate connecting seam member 84, 86, 88, 90 extending between the first lateral arcuate seam member 68, 70, 72, 74 and the second lateral arcuate seam member 76, 78, 80, 82.

The first hole 21 and second hole 22 are formed along the first lateral arcuate seam member 74 of the fourth horseshoe shaped seam section 50 within the second cover member 36, wherein the second hole 22 is formed closer to the arcuate connecting seam member 90 of the fourth horseshoe shaped seam section 50 and the first hole 21 is positioned closer to the second narrow seam section 42.

The third, sixth, fourth, and seventh holes 23, 26, 24, 27 are formed adjacent the first narrow seam section 40 along a line transverse to the longitudinal axis extending between the first and second lateral seam members 52, 54 making up the first narrow seam section 40. The third, sixth, fourth, and seventh holes 23, 26, 24, 27 are positioned closer to the first horseshoe shaped seam section 44 than the second horseshoe shaped seam section 46. In particular, the third hole 23 is formed in the second cover member 36 adjacent the first lateral seam member 52 of the first narrow seam section 40 (corresponding to the arcuate connecting seam member 90 of the fourth horseshoe shaped seam section 50), the sixth hole 26 is formed in the first cover member 34 adjacent the first lateral seam member 52 of the first narrow seam section 40 (corresponding to the arcuate connecting seam member 90 of the fourth horseshoe shaped seam section 50), the fourth hole 24 is formed in the first cover member 34 adjacent the second lateral seam member 54 of the first narrow seam section 40 (corresponding to the arcuate connecting seam member 88 of the third horseshoe shaped seam section 48), the seventh hole 27 is formed in the second cover member 36 adjacent the second lateral seam member 54 of the first narrow seam section 40 (corresponding to the arcuate connecting seam member 90 of the fourth horseshoe shaped seam section 50).

The fifth hole 25 is formed along the second narrow seam section 42. In particular, the fifth hole 25 is formed in the second cover member 36 adjacent the first lateral seam member 56 of the second narrow seam section 42 (corresponding to the arcuate connecting seam member 86 of the second horseshoe shaped seam section 46). The eighth hole 28 is formed within the first cover member 34 adjacent the first lateral arcuate seam member 70 of the second horseshoe shaped seam section 46. The ninth hole 29 is formed within the first cover member 34 adjacent the first lateral arcuate seam member 64 of the first horseshoe shaped seam section 44. Finally, the tenth hole 30 is formed in the second cover member 36 in the center of third horseshoe shaped seam section 48.

Now describing the softball embodiment as shown with reference to FIGS. 7 to 10, the first hole 121 and second hole 122 are formed along the second lateral arcuate seam member 180 of the third horseshoe shaped seam section 148 within the second cover member 136, wherein the second hole 122 is formed closer to the arcuate connecting seam member 188 of the third horseshoe shaped seam section 148 and the first hole 121 is positioned closer to the second narrow seam section 142.

The third, sixth, fourth, and seventh holes 123, 126, 124, 127 are formed adjacent the first narrow seam section 140 along a line transverse to the longitudinal axis extending between the first and second lateral seam members 152, 154 making up the first narrow seam section 140. The third, sixth, fourth, and seventh holes 123, 126, 124, 127 are positioned closer to the first horseshoe shaped seam section 144 than the second horseshoe shaped seam section 146. In particular, the third hole 123 is formed in the second cover member 136 adjacent the first lateral seam member 152 of the first narrow seam section 140 (corresponding to the arcuate connecting seam member 190 of the fourth horseshoe shaped seam section 150), the sixth hole 126 is formed in the first cover member 134 adjacent the first lateral seam member 452 of the first narrow seam section 140 (corresponding to the arcuate connecting seam member 190 of the fourth horseshoe shaped seam section 150), the fourth hole 124 is formed in the first cover member 134 adjacent the second lateral scam member 154 of the first narrow seam section 140 (corresponding to the arcuate connecting seam member 188 of the third horseshoe shaped seam section 148), the seventh hole 127 is formed in the second cover member 136 adjacent the second lateral seam member 154 of the first narrow seam section 140 (corresponding to the arcuate connecting seam member 190 of the fourth horseshoe shaped seam section 150).

The fifth hole 125 is formed along the second narrow seam section 142 toward the fourth horseshoe shaped seam section 150. In particular, the fifth hole 125 is formed in the second cover member 136 adjacent the second lateral seam member 158 (corresponding to the arcuate connecting seam member 184 of the first horseshoe shaped seam section 144) of the second narrow seam section 142.

Each of the various holes described above is shaped and dimensioned for selective attachment of a peg therein. In accordance with a preferred embodiment, each hole includes internal threading for engagement with external threading along the outer distal end of the various pegs used in accordance with the present invention.

Now that the balls used in accordance with the present invention have been described, use thereof (for a right handed pitcher) is described in detail below for the various pitches. As will be appreciated based upon the various figures, the fingers of the pitching hand are labeled as follows for the sake of explaining operation of the present training device: A—thumb; B—index finger; C—middle finger; D—ring finger; and E—pinky. It is appreciated, one training with the present invention might find it desirable to actually write A, B, C, D, and E on the tops of their fingers.

Softball—Fastball Instruction

1. Insert pegs in the first, second, third and fifth holes on the ball.
2. Attach band to the pegs positioned in the first and second holes.
3. Place fingers B and D on the outside of the pegs within the first and second holes.
4. Place finger C on the band.
5. Finger C should extend one joint beyond the band.
6. Fingers A and D should be adjacent to the pegs within the third and fifth holes on the inside portion of the holes.

Release ball in an upward motion while snapping wrist to right shoulder as ball leaves finger tips, fingertips continue to throwing shoulder.

Softball—Knuckle Ball Change-Up Instruction

1. Insert pegs in the first, second, fifth, sixth and seventh holes on the ball
2. Attach band to the pegs positioned within the first and second holes.
3. Place fingers B and C between seems and band with nails digging into ball.
4. Place finger A against right side of the peg positioned in the fifth hole.
5. Place finger D against the right side of the peg positioned in the sixth hole.
6. Place finger E adjacent of right side of the peg positioned in the seventh hole if reachable.

Release ball while pushing against band without breaking wrist to eliminate ball rotation.

Softball—Reverse Palm Change-Up Instruction

1. Insert pegs in the first, second, third or fifth holes on the ball.
2. Attach band to the pegs positioned with the first and second holes.
3. Place fingers B and D on the outside of the pegs positioned within the first and second holes.
4. Place finger C on the band.
5. Fingers should extend one joint beyond the band.
6. Fingers A and D should be adjacent to the third and fifth pegs on the inside portion of the holes.

Release ball with inverted wrist, fingers B, C, and D pull back on band follow through with fingertips pointing to target. Ball flight should produce as little arc as possible.

Softball—Curve Ball Instruction

1. Insert pegs in the third, fourth and fifth holes on the ball.
2. Place fingers B and C on left side of the pegs positioned in the third and fourth holes.
3. Place finger A on left side of the peg positioned in the fifth hole.

Release ball with a clockwise pressure against pegs, finger B points to left hip bone.

Softball—Screw Ball Instruction

1. Insert pegs in the third, fourth and fifth holes on the ball.
2. Place fingers B and C on left side of the pegs positioned in the third and fourth holes.
3. Place finger A on the left side of the peg positioned in the fifth hole.

Release ball with a clockwise pressure against pegs, finger B points to third base and palm rotates in same direction.

Softball—Drop Curve Instruction

1. Insert pegs in the fifth, sixth, and seventh holes on the ball.
2. Place fingers B and C on the right side of the pegs positioned in the sixth and seventh holes.
3. Place finger A on the right side of the peg positioned in the fifth hole.

Release ball while rotating wrist counter clockwise with downward pressure on pegs and finger B continuing to outside of left knee after release.

Softball—Drop Instruction

1. Insert pegs in the fifth, sixth, and seventh holes on the ball.
2. Place fingers B and C on the right side of the pegs positioned in the sixth and seventh holes.
3. Place finger A on the right side of the peg positioned in fifth hole.

Release ball while rotating wrist counter clockwise with downward pressure on pegs and finger B continuing to inside of right knee after release.

Softball—Rise Ball Instruction

1. Insert pegs in third, fourth and fifth holes on the ball.
2. Place fingers B and C on the left side of the pegs positioned in the third and fourth holes.
3. Place finger A on left side of the peg positioned in the fifth hole.

Release ball with a clockwise pressure against pegs, finger B following in front of forehead as palm continues upward in a corkscrew motion to sky.

Baseball—4 Seam Fastball Instruction

1. Insert pegs in the first, second and fifth holes on the ball.
2. Attach band to the pegs positioned in first and second holes.
3. Place fingers B and C on band.
4. Fingers should extend one joint beyond the band.
5. Rest finger D on top of the peg positioned in fifth hole.
6. Finger A should cradle ball gently.

Release ball with finger tips producing backward spin as arm extends to target.

Baseball—2 Seam Fastball Instruction

1. Insert pegs in the first, third and seventh holes on the ball.
2. Attach band to the pegs positioned in the third and seventh holes.
3. Place fingers B and C on band.
4. Fingers should extend one joint beyond the band.
5. Rest finger D on top of the peg positioned in hole.
6. Finger A should cradle ball gently.

Release ball with finger tips producing backward spin as arm extends to target.

Baseball—Slider Instruction

1. Insert pegs in the second and tenth holes on the ball.
2. Place fingers B and C against the left side of the peg positioned in the second hole.
3. Place finger A against the right side of the peg positioned in tenth hole.

Release ball with a slight clockwise spin.

Baseball—Splitter Instruction

1. Insert pegs in the eighth and ninth holes on the ball.
2. Place fingers B and C on top the pegs positioned in eighth and ninth holes.
3. Push ball deep into palm of the hand.

Release ball with a stiff wrist and downward pressure on pegs.

Baseball—Knuckle Curve Instruction

1. Insert pegs in the first and second holes on the ball.
2. Attach band to the pegs positioned in the first and second holes.
3. Place fingers B and C on band with nails digging into the ball.
4. Place finger A against the right side of the peg positioned in the seventh hole.
5. Place finger D against the left side of the peg positioned in fifth hole.

Release ball rotating wrist clockwise applying pressure to pegs.

Baseball—Drop Instruction

1. Insert pegs in the third, fourth and fifth holes on the ball.
2. Place fingers B and C on the left side of the pegs positioned in the third and fourth holes.
3. Place finger A on the right side of the peg positioned in the fifth hole.

Release ball while applying downward pressure on the pegs positioned in the third and fourth holes and upward motion on the peg positioned in the fifth hole. Creating a 12 to 6 spin on the ball as it approaches the plate.

Baseball—Screw Ball Instruction

1. Insert pegs in the third, fourth and fifth holes on the ball.
2. Place fingers B and C on the right side of the pegs positioned in the third and fourth holes.
3. Place finger A on the left side of the peg positioned in the fifth hole.

Release ball with a counter clockwise pressure against pegs.

Baseball—Curve Ball Instruction

1. Insert pegs in the third, fourth and fifth holes on the ball.
2. Place fingers B and C on the left side of the pegs positioned in the third and fourth holes.
3. Place finger A on the right side of the peg positioned on the fifth hole.

Release ball with a clockwise pressure against pegs.

Baseball—Knuckle Ball Instruction

1. Insert pegs in the first and second holes on ball.
2. Attach band to the pegs positioned in the first and second holes.
3. Place fingers B and C between seems and band with nails digging into the ball.
4. Place finger A against the right side of the peg positioned in the seventh hole.
5. Place finger D against the right side of the peg positioned in the fifth hole.

Release ball while pushing against band without breaking wrist to eliminate ball rotation.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A pitching movement training device, comprising:

a ball including a seam;

a plurality of pegs extending from an upper surface of the ball and selectively secured at predetermined locations about a surface of the ball; and at least one rubber band attached to a first peg and a second peg such that the rubber band is secured between the first and second pegs.

2. The pitching movement training device according to claim 1, wherein the ball is a baseball.

3. The pitching movement training device according to claim 2, wherein the ball includes ten holes shaped and dimensioned for receiving the pegs.

4. The pitching movement training device according to claim 1, wherein the ball is a softball.

5. The pitching movement training device according to claim 4, wherein the ball includes seven holes shaped and dimensioned for receiving the pegs.

6. The pitching movement training device according to claim 4, wherein the ball includes a seam and the pegs are positioned adjacent the seam.

7. The pitching movement training device according to claim 1, wherein the ball includes a plurality of threaded holes shaped and dimensioned for receiving the pegs.

8. A pitching movement training device, comprising:

a ball including a single seam securing a first cover member to a second cover member, the single seam being formed in a serpentine pattern including first and second narrow seam sections connecting first, second, third and fourth horseshoe shaped seam sections, wherein each of the first, second, third and fourth horseshoe shaped seam sections includes a first lateral arcuate seam member, a second lateral arcuate seam member and an arcuate connecting seam member extending between the first lateral arcuate seam member and the second lateral arcuate seam member;

a plurality of holes formed in the ball at predetermined locations, the plurality of holes including a first hole and a second hole formed along the first lateral arcuate seam member of the fourth horseshoe shaped seam section within the second cover member, wherein the second hole is formed closer to the arcuate connecting seam member of the fourth horseshoe shaped seam section and the first hole is positioned closer to the second narrow seam section;

a plurality of pegs extending from an upper surface of the ball and selectively secured to some of the plurality of holes at predetermined locations about a surface of the ball, at least one of the pegs being positioned adjacent the single seam; and at least one rubber band attached to a first peg and a second peg such that the rubber band is secured between the first and second pegs.

9. The pitching movement training device according to claim 8, wherein the ball is a baseball.

10. The pitching movement training device according to claim 9, wherein the ball includes ten holes shaped and dimensioned for receiving the pegs.

11. The pitching movement training device according to claim 8, wherein the ball is a softball.

12. The pitching movement training device according to claim 11, wherein the ball includes seven holes shaped and dimensioned for receiving the pegs.

13. The pitching movement training device according to claim 8, wherein the plurality of holes includes third, fourth, fifth, sixth, and seventh holes, the third fourth, sixth and seventh holes being formed adjacent the first narrow seam section along a line transverse to a longitudinal axis extending between the first and second lateral seam members making up the first narrow seam section.

14. The pitching movement training device according to claim 13, wherein the third, fourth, sixth, seventh holes are positioned closer to the first horseshoe shaped seam section than the second horseshoe shaped seam section.

15. A pitching movement training device, comprising:

a ball including a single seam securing a first cover member to a second cover member, the single seam being formed in a serpentine pattern including first and second narrow seam sections connecting first, second, third and fourth horseshoe shaped seam sections, wherein each of the first, second, third and fourth horseshoe shaped seam sections includes a first lateral arcuate seam member, a second lateral arcuate seam member and an arcuate connecting seam member extending between the first lateral arcuate seam member and the second lateral arcuate seam member;

a plurality of holes formed in the ball at predetermined locations, the plurality of holes including a first hole and a second hole formed along the first lateral arcuate seam member of the fourth horseshoe shaped seam section within the second cover member, wherein the second hole is formed closer to the arcuate connecting seam member of the fourth horseshoe shaped seam section and the first hole is positioned closer to the second narrow seam section;

a plurality of pegs extending from an upper surface of the ball and selectively secured to some of the plurality of holes at predetermined locations about a surface of the ball, at least one of the pegs being positioned adjacent the single seam;

wherein the plurality of holes includes third, fourth, fifth, sixth and seventh holes, the third, fourth, sixth and seventh holes being formed adjacent the first narrow seam section along a line transverse to a longitudinal axis extending between the first and second lateral seam members making up the first narrow seam section;

wherein the third, fourth, sixth, seventh holes are positioned closer to the first horseshoe shaped seam section than the second horseshoe seam section; and wherein the third hole is formed in the second cover member adjacent the first lateral seam member of the first narrow seam section, the sixth hole is formed in the first cover member adjacent the first lateral seam member of the first narrow seam section, the fourth hole is formed in the first cover member adjacent the second lateral seam member of the first narrow seam section, the seventh hole is formed in the second cover member adjacent second lateral seam member of the first narrow seam section.

16. The pitching movement training device according to claim 15, wherein the fifth hole is formed along the second narrow seam section.

17. The pitching movement training device according to claim 15, wherein the fifth hole is formed in the second cover member adjacent the first lateral seam member of the second narrow seam section.

18. The pitching movement training device according to claim 15, wherein the plurality of holes includes an eighth holes, a ninth hole and a tenth hole, the eighth hole is formed within the first cover member adjacent the first lateral arcuate seam member of the second horseshoe shaped seam section, the ninth hole is formed within the first cover member adjacent the first lateral arcuate seam member of the first horseshoe shaped seam section, and the tenth hole is formed in the second cover member in a center of third horseshoe shaped seam section.

* * * * *